US005997021A

United States Patent [19]

Robinson et al.

[11] Patent Number: 5,997,021

[45] Date of Patent: Dec. 7, 1999

[54] ADJUSTABLE SEAT BACK ASSEMBLY FOR A WHEELCHAIR

[75] Inventors: William G. Robinson; Robert A. Taylor, both of Fresno, Calif.

[73] Assignee: Sunrise Medical HHG Inc., Longmont, Colo.

[21] Appl. No.: 08/944,810

[22] Filed: Oct. 6, 1997

Related U.S. Application Data

[63] Continuation-in-part of application No. 08/579,483, Dec. 27, 1995, which is a continuation-in-part of application No. 08/365,261, Dec. 28, 1994, Pat. No. 5,590,893.

[51] Int. Cl.[6] ..... A47C 7/46; A61G 5/10

[52] U.S. Cl. ..... 280/250.1; 280/304.1; 297/327; 297/354.12

[58] Field of Search ..... 280/250.1, 304.1; 297/325, 326, 327, 340, 354.1, 354.12, 376, 364, DIG. 4, 452.11

[56] References Cited

U.S. PATENT DOCUMENTS

| | | | |
|---|---|---|---|
| 2,236,089 | 3/1941 | Ducavich . | |
| 2,792,876 | 5/1957 | Emary . | |
| 3,784,252 | 1/1974 | Peterson | 297/363 |
| 3,866,250 | 2/1975 | Bradford | 5/76 |
| 5,263,768 | 11/1993 | Scheulderman | 297/DIG. 4 |
| 5,409,247 | 4/1995 | Robertson et al. | 280/250.1 |
| 5,551,756 | 9/1996 | Gurasich et al. | 297/440.2 |
| 5,590,893 | 1/1997 | Robinson et al. | 280/250.1 |
| 5,593,211 | 1/1997 | Jay et al. | 297/383 |

FOREIGN PATENT DOCUMENTS

| | | | |
|---|---|---|---|
| 456271 | 11/1936 | United Kingdom | 297/363 |

*Primary Examiner*—Anne Marie Boehler
*Attorney, Agent, or Firm*—MacMillan, Sobanski & Todd, LLC

[57] ABSTRACT

An adjustable seat back assembly for a wheelchair of the type having a frame with an upwardly extending rear frame portion and an adjustable angle seat support which includes a pivotable front end and a rear end which is secured to said rear frame portion at any of a plurality of different positions. A seat back support is mounted to pivot on the seat support from adjacent its rear end. A link connects the seat support to a slider on the rear frame portion to maintain the position of the slider relative to the seat back support pivot as the seat angle is adjusted. A releasable seat back angle adjuster secures the seat back support to the slider at any of a plurality of positions. When the seat back angle adjuster is released, the seat back support may be folded down towards said seat support.

4 Claims, 9 Drawing Sheets

ADJUSTABLE SEAT BACK ASSEMBLY FOR A WHEELCHAIR

CROSS-REFERENCE TO RELATED APPLICATIONS

This is a continuation-in-part of U.S. application Ser. No. 08/579,483 filed Dec. 27, 1995, which in turn is a continuation-in-part of application Ser. No. 08/365,261 filed Dec. 28, 1994, now U.S. Pat. No. 5,590,893, the disclosure of which is incorporated by reference.

STATEMENT REGARDING FEDERALLY SPONSORED RESEARCH OR DEVELOPMENT

Not Applicable.

BACKGROUND OF THE INVENTION

Adjustable wheelchairs are frequently used by persons requiring wheelchairs who are involved in action sports such as basketball, tennis and other sports. As taught, for example, in U.S. Pat. No. 5,509,893, various settings of a wheelchair may be made adjustable, including the wheel location relative to the center of gravity, the wheel camber, and the seat angle.

The seat, for example, may be mounted to top rails or supports on side frames for the wheelchair. The top rail on each side frame is pivoted from near the front of the frame over an arc on a back frame member for seat angle adjustment. Quick release pins may be provided to secure the top rails to the back frame member at any of a plurality of discrete locations to provide a number of discrete seat angles. The lower end of seat back supports are hinged to each top rail. The back supports also are each connected to a slider which slides on the back frame member as the seat angle is adjusted. Consequently, the seat back moves up and down with the back of the seat as the seat angle is adjusted. The seat back angle will remain substantially constant as the seat angle is adjusted. There has been no provision for easily changing the angle of the seat back to accommodate the needs of a user or to permit the seat back supports to be easily folded down for storage or transport without the use of tools.

BRIEF SUMMARY OF THE INVENTION

The present invention is directed to an adjustable back for a wheelchair which allows easy adjustment of the seat back angle to accommodate the comfort and the needs of the wheelchair user. Seat back supports are pivotally mounted to left and right side frame top members at their lower ends for positioning at different angular orientations. The angular orientation of the seat back support can be changed by the user while sitting in the wheelchair by simply pulling on a lanyard to disengage release pins from a sliding bracket on a rear frame member. When the pins are disengaged, the seat back is free to be pivoted forwardly or rearwardly according to the desires or needs of the user. When the seat back is in a desired position, the lanyard is released and the pins reengage the bracket to lock the seat back at the set angle. The seat back position may be easily changed several times a day if desired. This not only helps to ensure user comfort but also helps to change pressure points, to help reduce incidence of pressure sores. Further, when the wheelchair is used for basketball, tennis or other sports, the seat back may be quickly set to a desired angle while playing the sport and reset to a different angle after the sport is completed.

Accordingly, it is an object of the invention to provide an easily adjusted seat back for a wheelchair.

Other objects and advantages of the invention will become apparent from the following detailed description of the invention and the accompanying drawings.

DETAILED DESCRIPTION OF THE INVENTION

Figure 1:
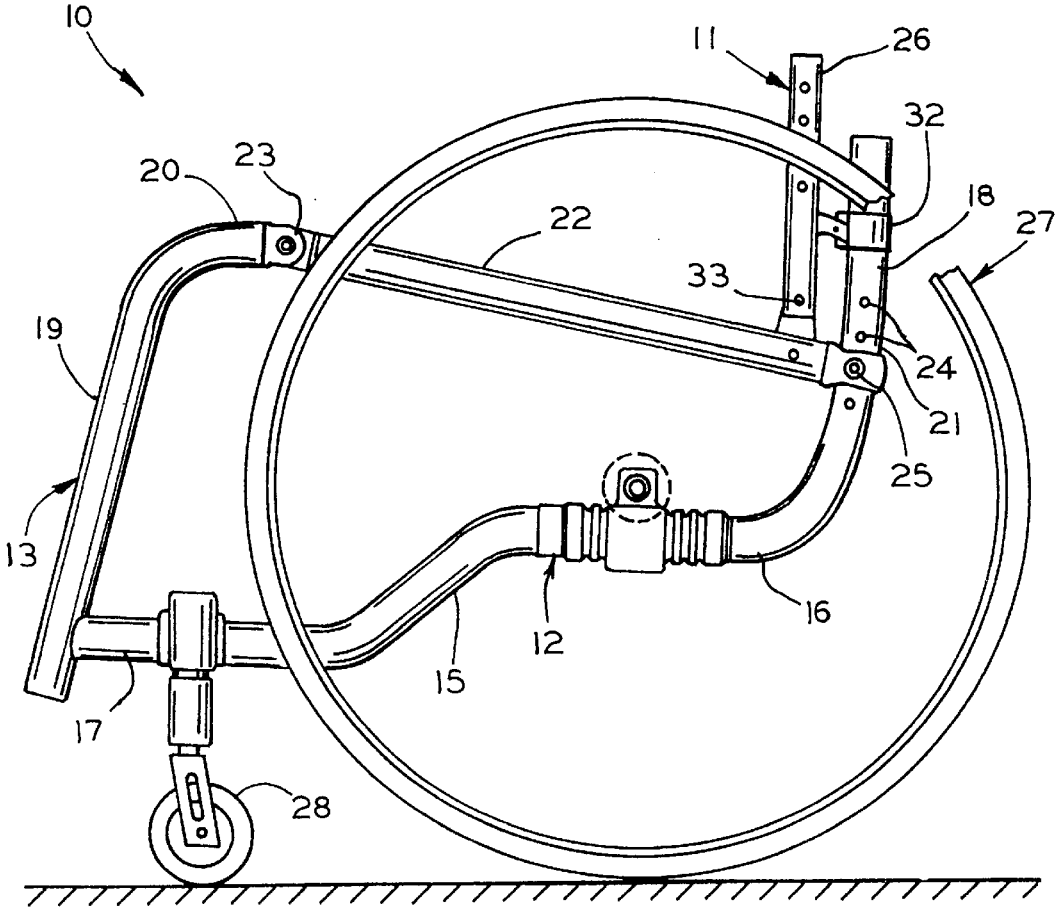
FIG. 1 is a fragmentary side elevational diagrammatic view of a wheelchair including an adjustable seat back assembly according to the invention with the seat and the seat back shown in dashed lines.
Figure 2:
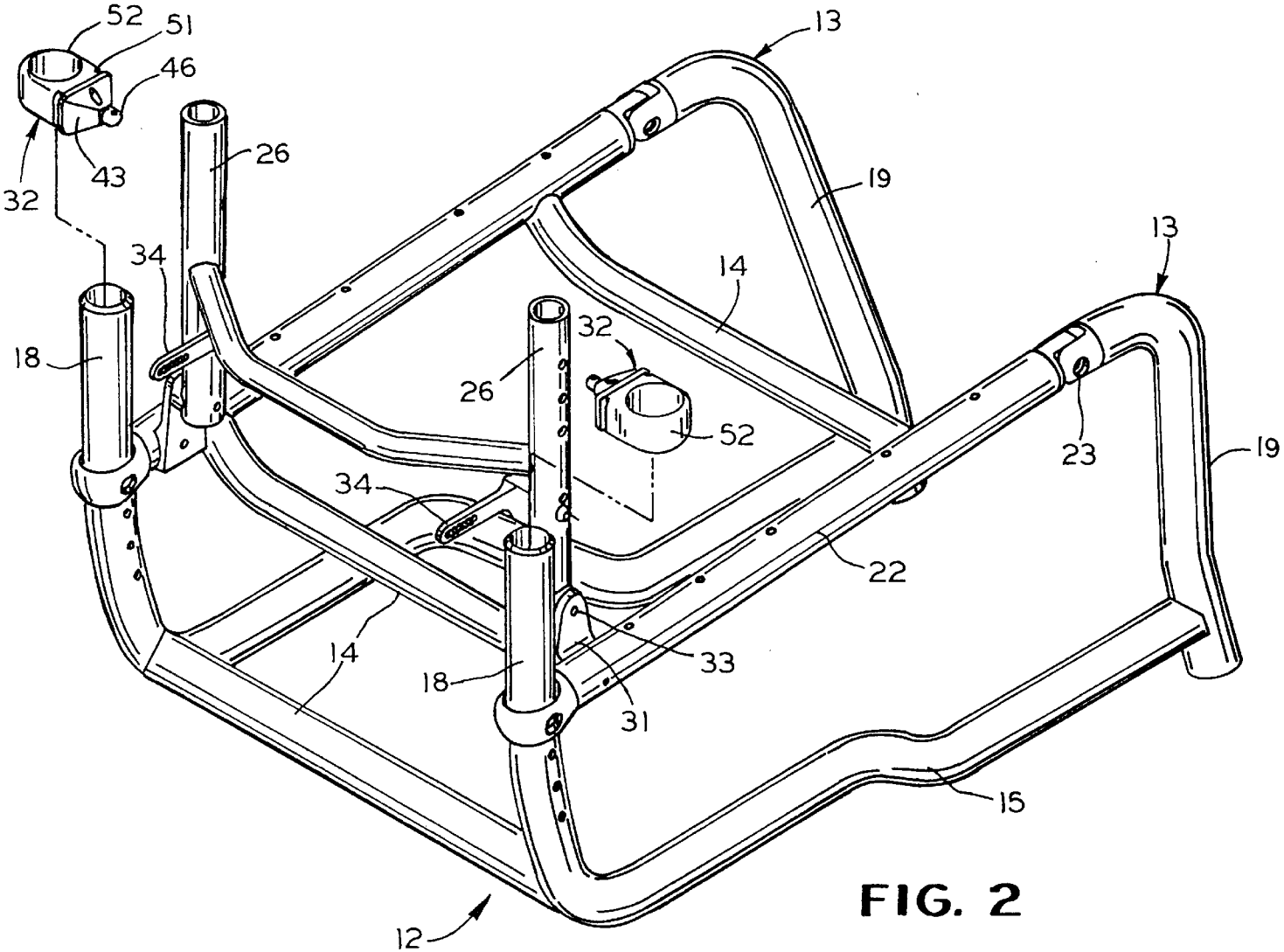
FIG. 2 is a perspective view of the frame assembly for the wheelchair 10.
Figure 3:
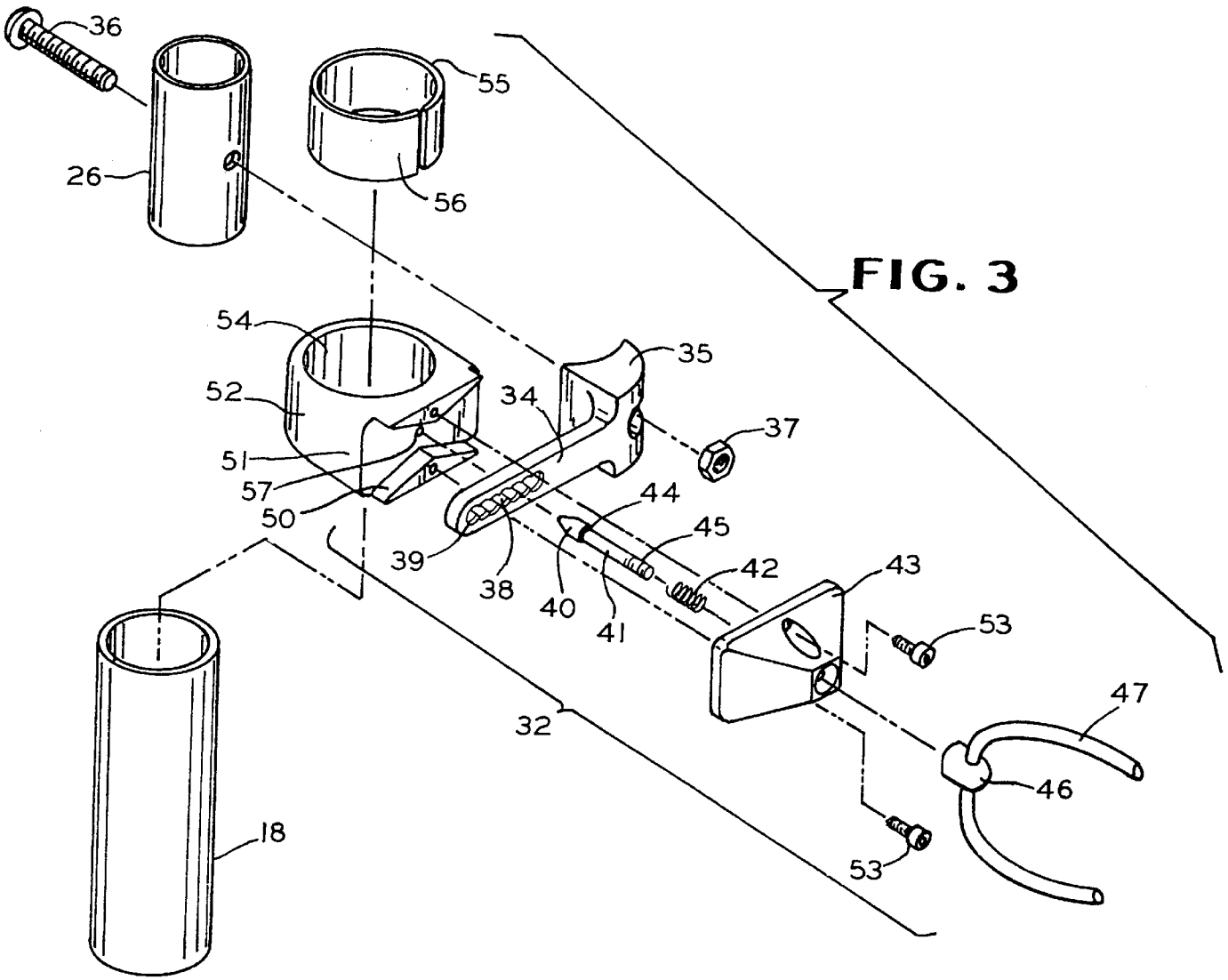
FIG. 3 is an exploded fragmentary perspective view of an adjuster assembly used to permit the seat back to be positioned in a plurality of forward to rearward pivotal positions by the user.

FIG. 1 of the drawings illustrates a wheelchair 10 incorporating an adjustable seat back assembly 11 according to the invention and FIG. 2 shows details of a frame assembly 12 for the wheelchair 10. As best shown in FIG. 2, the frame assembly 12 includes two side frames 13 connected together by a plurality of lateral supports 14. Each side frame 13 includes a lower frame portion 15, each of which has a rear end 16 and a front end 17. A rear frame portion 18 extends upwardly from the rear end 17 of the lower frame portion 15 and a front frame portion 19 extends upwardly from the front end 16 of the lower frame portion 15. An upper end 20 of the front frame portion 19 and an area 21 of the rear frame portion 18 are coupled by a top rail or seat portion 22. The seat portion 22 is pivotally mounted to an upper end of the front frame portion 19 at a pivot 23 and is adjustably mounted to one of several positions defined by holes 24 in the rear frame portion area 21. The seat portion 22 is secured to a selected one of the holes 24 by a quick release pin 25. An adjustable seat back support 26 is mounted to a rear end of each seat portion 22 and to each rear frame portion 18. A conventional seat (not shown) is mounted to the seat portions 22 on each side frame 13 and a conventional backrest (not shown) is mounted to the seat back supports 26. For simplicity of illustration, the seat and backrest are not shown.

Drive wheels 27 and casters wheels 28 are mounted on each lower frame member 15. Details for preferred mountings for the drive wheels 27 and caster wheels 28 are shown in U.S. Pat. No. 5,590,893, the disclosure of which is incorporated herein.

FIGS. 3–7 show an adjuster assembly 32 according to one embodiment of the invention by which the angle of the seat back support 26 can be adjusted by the user while sitting in the wheelchair 10 without the use of tools. Each back support 26 is mounted to a seat portion 16 of the frame assembly 12 by a hinge or pivot 33 on a bracket 31 so that the seat back supports 26 can pivot forward and backwards on pivot pins 33. To maintain the seat back supports 26 in a desired orientation and to permit the seat back supports 26 to be folded down, an angle adjustment arm 34 is secured by a bracket 35 to each seat back support 26. A bolt 36 and a nut 37 secure each bracket 35 to a seat back support 26. While the position of the bracket 35 along the seat back support 26 could be adjusted or changed, in practice it is generally secured in one position. Alternately, some type of quick release fastener may be used for securing the bracket 35.

The arm 34 has a number of intersecting, parallel bores 38 having countersunk ends 39. The bores 38 are sized for receipt of a tapered end 40 on a release pin 41. The release pin 41 is biased toward engagement with a selected bore 38 by a compression spring 42. The compression spring 42 is mounted over the release pin 41 and is captured between the end of a countersunk opening (not shown) formed in an adjustment arm receiver plate 43 and a shoulder 44 adjacent the end 40 of the release pin 41. An outer end 45 of the release pin 41 is threaded for being secured to a knob 46 to which a lanyard 47 is secured. Pulling on the lanyard 47, which can be accomplished by many wheelchair users while seated in the wheelchair, pulls on the knob 46 so as to compress the spring 42 to disengage the release pin 41 from a bore 38.

The adjustment arm 34 is captured between double tapered faces 50 in an adjustment arm receiver body 51. In one preferred embodiment, the body 51 is a one piece integral extension of a slider body 52. The receiver body 51 combines with the receiver plate 43 to form an adjustment receiver with the two parts secured together by cap screws 53.

The slider body 52 includes a central bore 54 which houses an anti-scratch liner 55. An outer surface 56 of the liner 55 is adhered to the wall of the bore 54 using a suitable adhesive. The liner 55 is relatively soft and snugly positions the slider body 52 about the rear frame portion 18. The liner 55 may be, for example, a length of looped fabric material, such as material sold under the trademark Velcro®.

Figure 4:
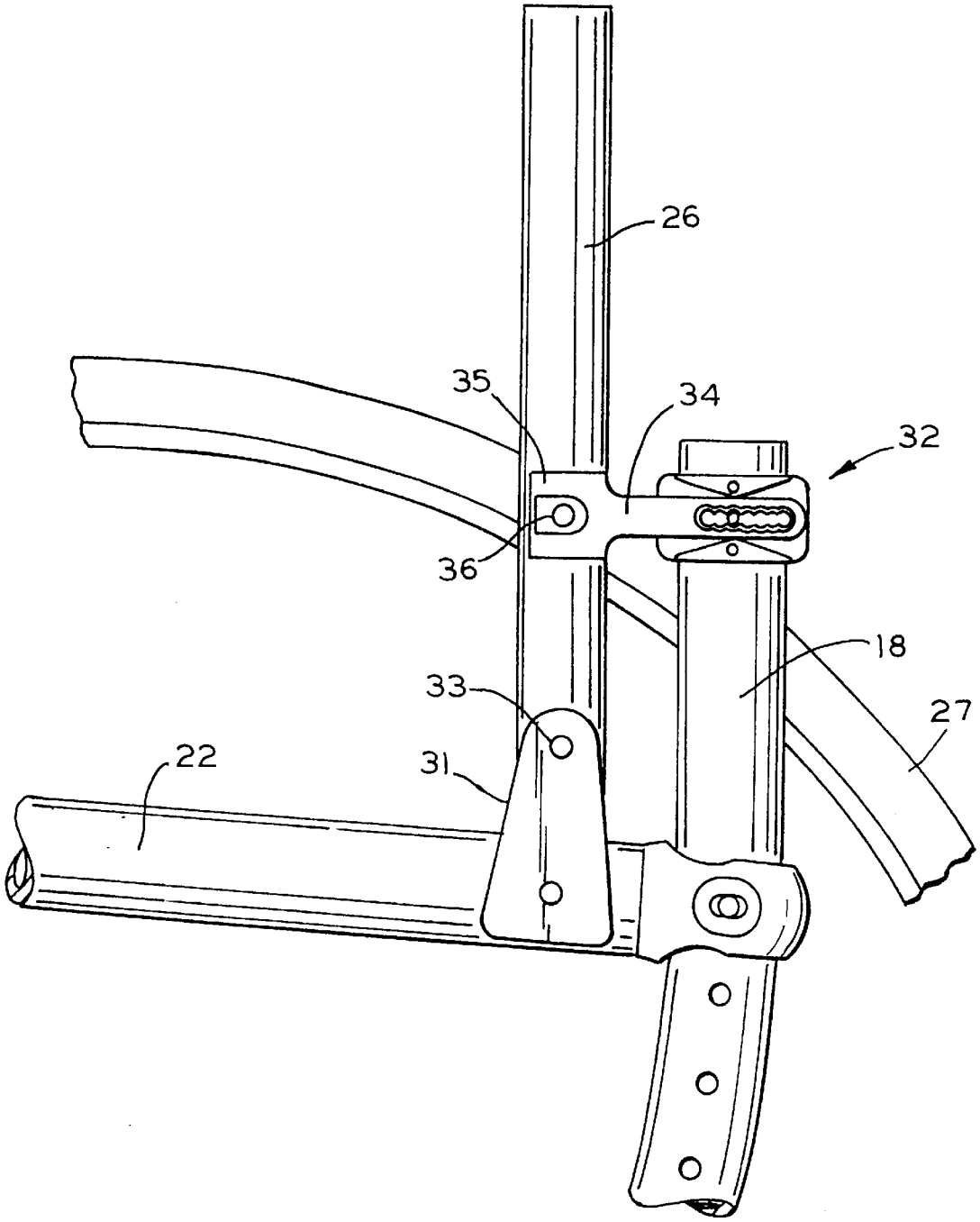
FIG. 4 is a somewhat simplified fragmentary side elevational view of a portion of the frame assembly of FIG. 2 shown with the arm receiving plate of the adjuster assembly removed and the seat back support shown in a vertical position.

FIG. 4 illustrates the seat portion 22 at its topmost position, that is, with about 1 inch (2.5 centimeters) drop front to back and the seat back support 26 is generally vertical. To change the orientation of the seat back support 26 rearwardly about 6.5° to the position of FIG. 5, the lanyard 47 is grasped and pulled upwardly. This pulls on the knobs 46 for each adjuster assembly 32, withdrawing the tapered ends 40 of the release pins 41 from an opening 57 in the adjustment arm receiver body 51 and at least partly from the bore 38 to permit the seat back support 26 to be rotated rearwardly. As the seat back support 26 is rotated, different bores 38 become aligned with the release pin 41. When the desires seat back position is achieved, the lanyard 47 is released and the springs 42 move the tapered end 40 of each release pin 41 to engage an adjustment arm bore 38 and to reseat within the opening 57. Thus, the seat back supports 26 are locked in the new position.

Figure 5:
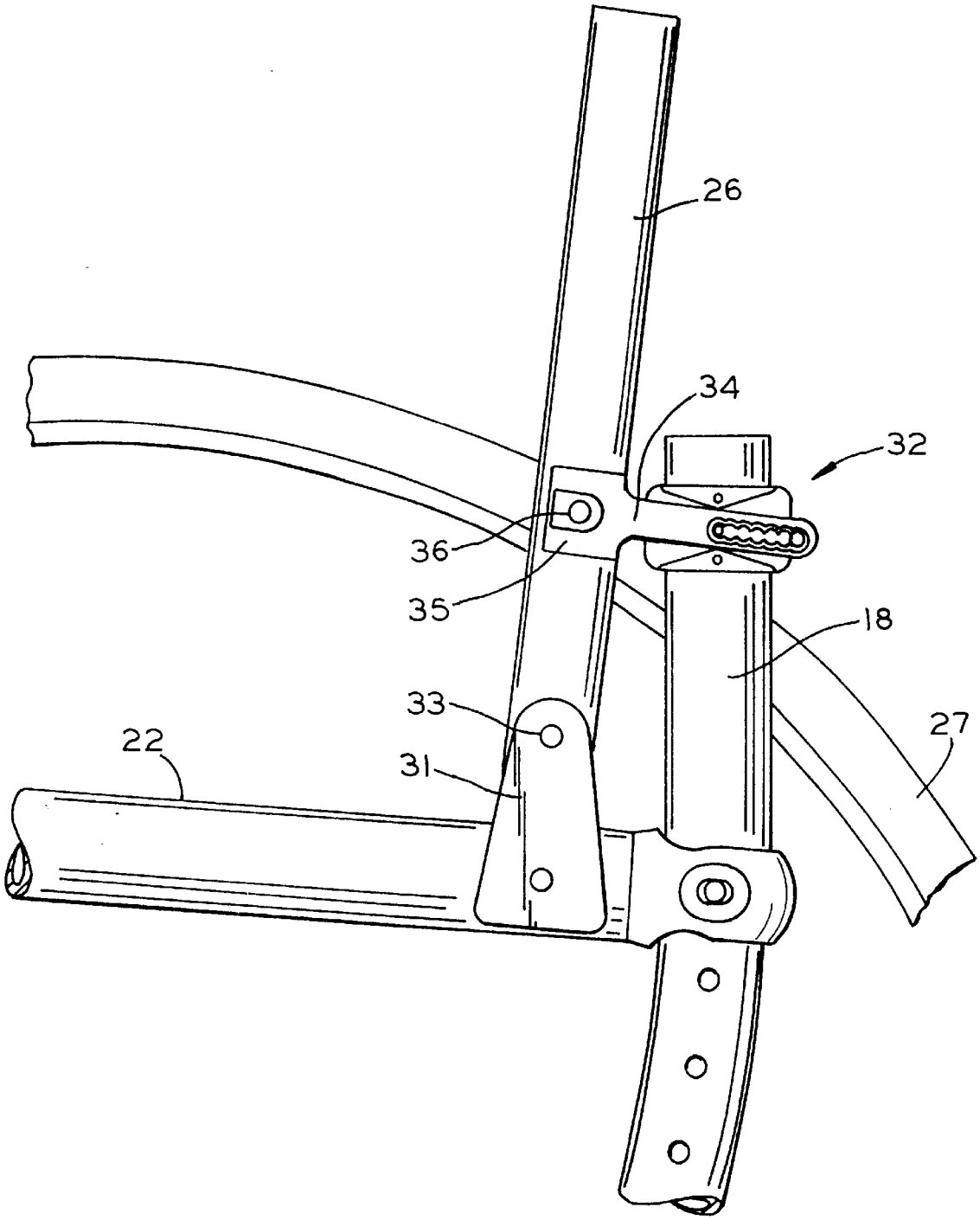
FIG. 5 is a fragmentary side elevational view similar to FIG. 4, but showing the seat back support in a rearwardly inclining setting.
Figure 6:
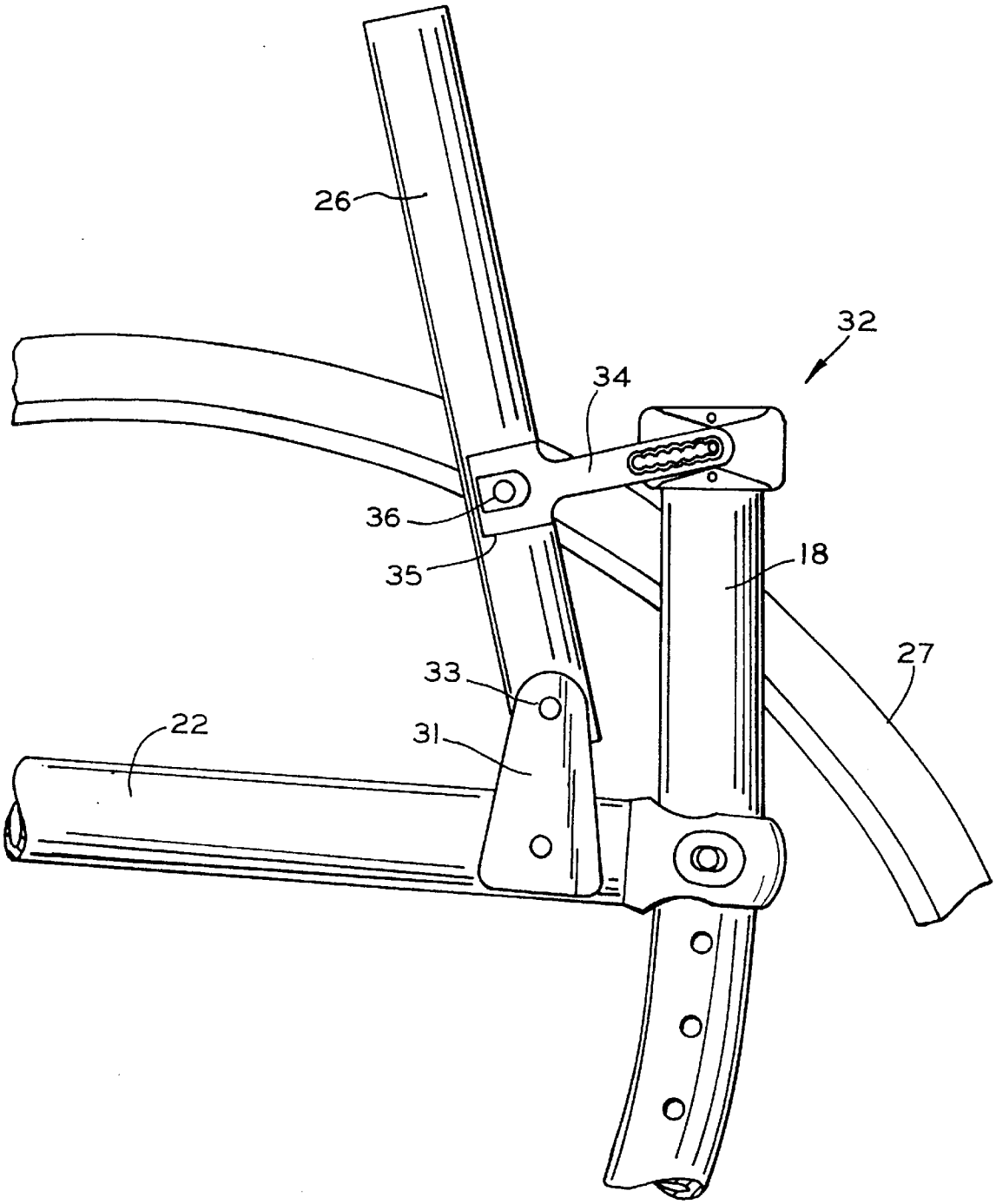
FIG. 6 is a fragmentary side elevational view similar to FIG. 4, but showing the seat back support in a forwardly inclining setting.

FIG. 6 shows the seat back support 26 at the opposite extreme, that is, angled about 12° forward from a vertical axis as opposed to the 6.5° backward lean from a vertical axis of FIG. 5. This is achieved in the same way, that is, by pulling the lanyard 47 and pulling the seat back support 28 in the desired direction. As can be seen by comparing the positions of the slider body 52 in FIGS. 5 and 6, the pivotal movement of the seat back support 26 is accommodated by the movement of the slider body 52 along the rear frame portion 19. Once the release pin 41 fully engages a bore 38, a rigid triangle is created between the pivot pin 33, the bolt 36 and the release pin 41. Thus, it is not necessary to lock the-slider body 52 to the rear frame portion 18 to maintain the seat back support 26 in a desired position.

The adjuster assembly 32 is shown with the adjustment arm 34 extending from the seat back support 26. If desired, the adjustment arm 34 could extend from the rear frame portion 18. Also, regardless of whether the adjustment arm 34 extends from the seat back support 26 or from the rear frame portion 18, the slider body 52 and the adjustment arm mounting bracket 35 can be reversed so that the slider body 52 slides over the seat back support 26 and the adjustment arm mounting bracket 35 is fixed to the rear frame portion 18.

Also, the use of the lanyard 47 provides a simple and inexpensive means for disengaging the release pins 41 to permit the seat back supports 26 to be rotated forward or rearward. If desired, other types of actuators can be provided in lieu of the lanyard 47. Further, the seat back support 26 can be spring biased in a forward direction, for example, by a torsion spring at the pivot pin 33. This will allow the user, while seated in the wheelchair 10, to sit at a desired position while pulling the lanyard 47. The seat back will then move to abut the user's back. When the lanyard 47 is then released, the seat back will be locked in the set position.

Figure 7:
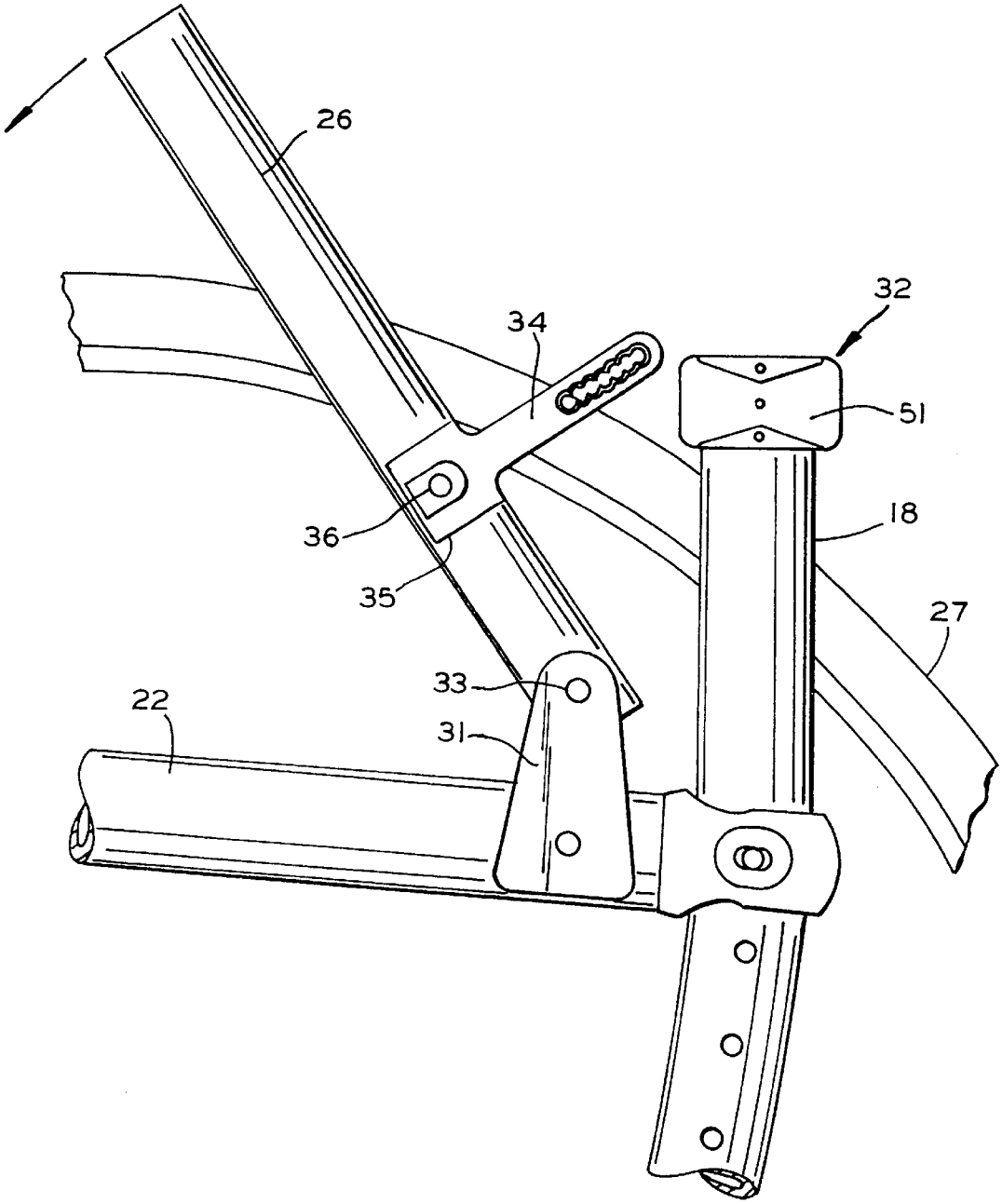
FIG. 7 is a fragmentary side elevational view similar to FIG. 4, but showing the seat back support disengaged from the frame to permit folding down the seat back.

FIG. 7 illustrated the complete removal of the angle adjustment arm 34 from the adjustment arm receiver body 51 to permit the seat back support 26 to be folded down to a generally horizontal position adjacent the seat portion 22. The seat back is typically folded down for storage or during transport. The double tapered faces 50 aid in guiding the angle adjustment arm 34 into the adjustment arm receiver body 51. The receiver body 51 is made with the double tapered faces 50 on each side so that a single part, in this case the slider body 52 and the receiver body 51, can be used on the seat back support 26 on either side of the wheelchair. Optionally, a sliding key arrangement (not shown) can be provided between the rear frame portion 18 and the slider body 52 to prevent rotation of the slider body on the rear frame portion 18, while permitting the slider body 52 to slide in an axial direction. This will facilitate alignment of the angle adjustment arm 34 with the adjustment arm receiver body 51 when the seat back is returned from the folded down position to an upright position.

Figure 8:
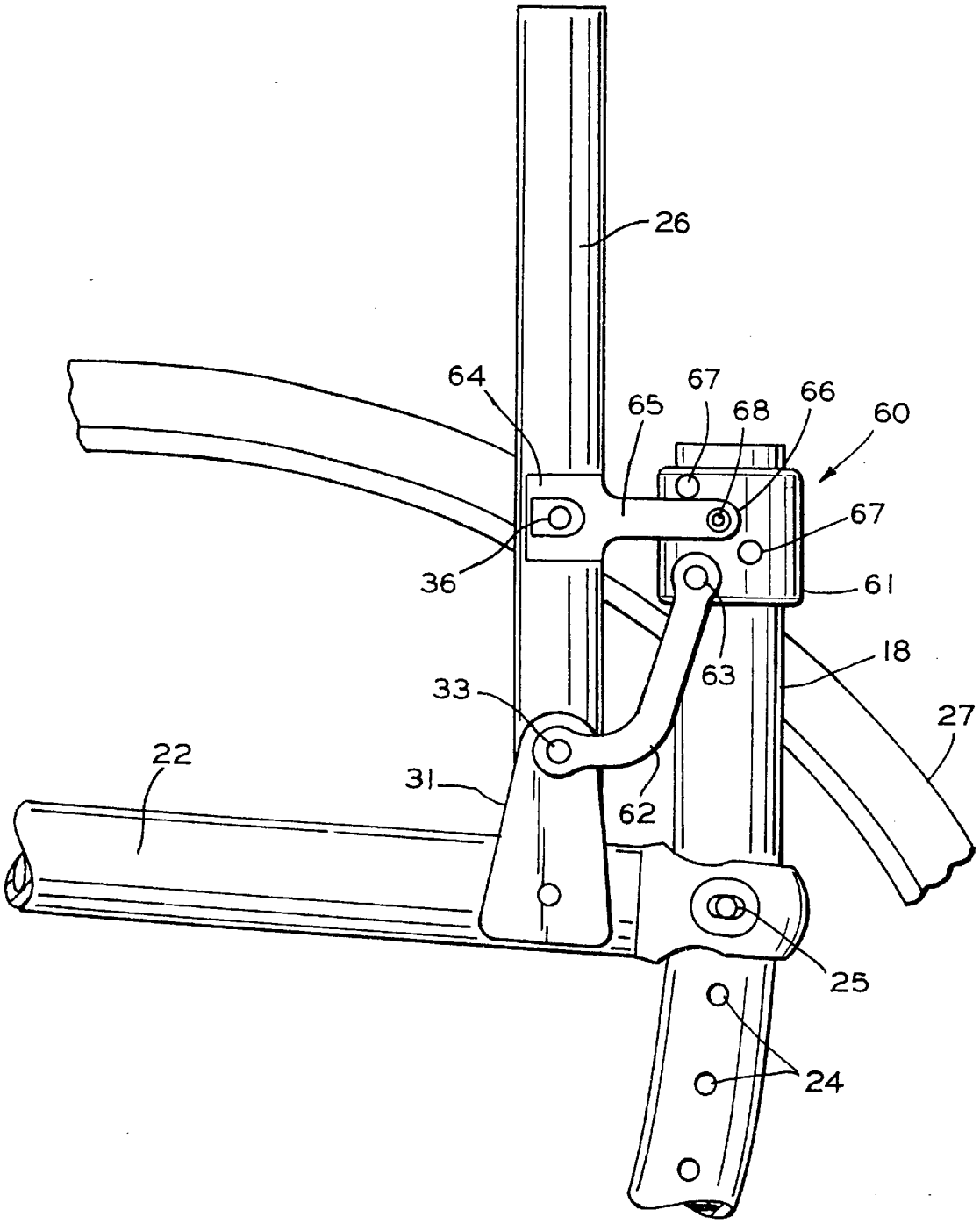
FIG. 8 is a somewhat simplified fragmentary side elevational view of a portion of the frame assembly showing an adjustable seat back assembly with an adjuster assembly according to a modified embodiment of the invention.

FIG. 8 shows a fragmentary portion of a seat back angle adjuster assembly 60 according to a modified embodiment of the invention. The wheelchair wheel 27, the rear frame portion 18, the seat portion 22, the seat back support 26, the seat back support bracket 31 and the pivot pin 33 remain the same as in FIGS. 4–7. For each side of the wheelchair, the seat back angle adjuster assembly 60 includes a modified slider 61 which slides up and down in an axial direction along the rear frame portion 18. A link 62 connects the slider 61 to the seat support 22 and preferably to the pivot pin 33 on the seat support 22. A rivet, screw or pin 63 connects the link 62 to the slider 61. The link 62 maintains the relative spacing between the seat back pivot pin 33 and the slider 61 as the angle of the seat portion 22 is adjusted. Also, the link 62 prevents the slider 61 from rotating on the rear frame portion 18.

A bracket 64 is secured to the seat back support 26 with the bolt 36. An angle adjustment arm 65 extends from the bracket 64. The arm 65 releasably engages the slider 61 for positioning the seat back support 26 at a selected angle relative to the seat portion 22 and for permitting the seat back support 26 to be folded down to adjacent the seat portion 22 for transportation or storage. A free end 66 of the arm 65 is secured to a desired position 67 on the slider 61. The different positions 67 may be defined, for example, by holes in the slider 61 which are engaged by a quick release pin 68 on the arm 65. Although only three positions 67 are shown in FIG. 8, it will be appreciated that any desired number of positions 67 may be provided and that they may be located to provide desired seat back angles. Since the seat back support 26 rotates about the pivot pin 33, the positions are located on a circle at a fixed radius from the pivot pin 33 so that the quick release pin 68 will always align with each of the positions 67 as the seat back angle is adjusted. A lanyard (not shown) may be provided for operating the release pins 68 to facilitate seat back angle adjustment by a user while seated in the wheelchair.

FIG. 8 shows the arm 65 disengaged from the slider 61 as the seat back support 26 is pivoted or folded down towards the seat portion 22. It will be seen that the position of the slider 61 is maintained relative to the pivot pin 33 by the link 62 and that the slider 61 is prevented from rotating on the rear frame portion 18. Consequently, when the seat back supports 26 are returned to their upright position, the quick release pin 66 on each arm 65 will align with the positions 67 on the slider 61.

Figure 9:
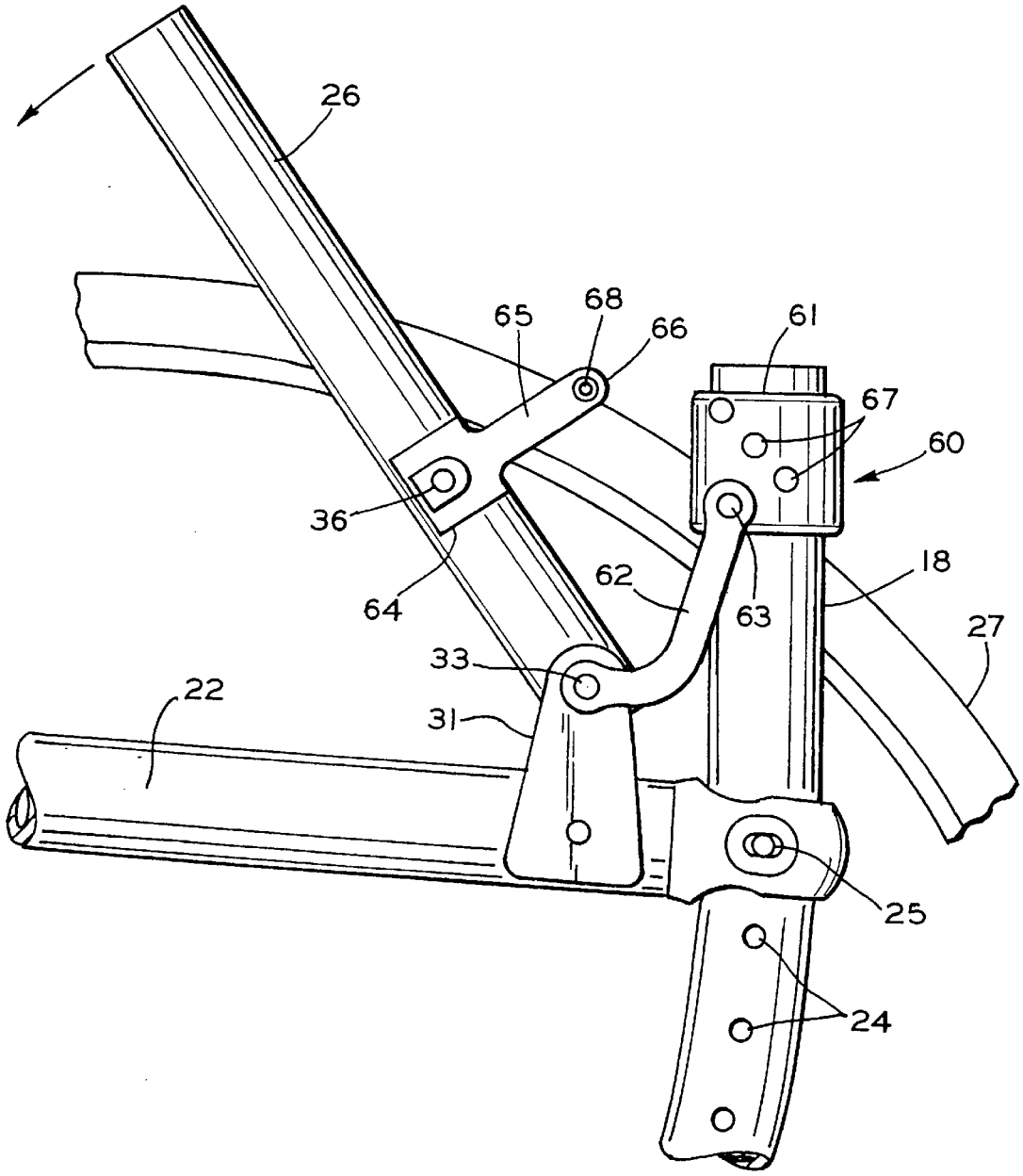
FIG. 9 is a fragmentary side elevational view similar to FIG. 8, but showing the seat back support disengaged from the frame to permit folding down the seat back.

In the embodiment shown in FIGS. 3–7, the quick release pin 41 is shown mounted on the adjuster assembly 32 for engaging the arm 34, while in the embodiment shown in FIGS. 8–9 the quick release pin 66 is mounted on the is on the arm 65 for engaging the slider 61. It will be appreciated that the quick release pin may be located either on the arm secured to the seat back support 28 or on the slider which slides on the rear frame portion. Further, it will be appreciated that a link 62 may be used for positioning the adjuster assembly 32 of FIGS. 3–7 relative to the pivot pin 33. The link 62 will assure that each arm 39 will automatically align with the passage between the tapered faces 50 and the receiver plate 43 when the seat back supports are returned from a folded down position to an upright position.

It will be appreciated that various modifications and changes may be made to the above described preferred embodiment of without departing from the scope of the following claims. Although the link 62 is shown attached to the pivot 33, it will be appreciated that it may be attached to another location on the seat support 22 so as to maintain a constant spacing from the pivot 33 as the angle of the seat support 22 is adjusted.

We claim:

1. In combination with a wheelchair having a frame with an upwardly extending rear frame portion and an adjustable angle seat support which includes a pivotable front end and a rear end which is secured to said rear frame portion at any of a plurality of different positions, an adjustable seat back assembly comprising a seat back support having a lower end pivotally connected to said seat support adjacent said rear end, a slider positioned to slide on said frame rear end, a link connected between said slider and said seat support to maintain a predetermined spacing between said slider and said seat support when the angle of said seat support is adjusted, and a seat back angle adjuster releasably connecting said seat back support to said slider in a plurality of different angular positions relative to said seat support.

2. An assembly, as set forth in claim 1, and wherein said seat back angle adjuster includes a bracket secured to said seat back support, said bracket having a projecting arm, and means for releasably securing said projecting arm to said slider in said plurality of different angular positions.

3. An assembly, as set forth in claim 2, and wherein said slider includes a separate hole for each of said positions, said holes being spaced about a circle having a center at said pivotal connection on the lower end of said seat back support, and wherein said means for releasably securing said projecting arm to said slider includes a release pin located to selectively engage said holes.

4. An assembly, as set forth in claim 1, and wherein said link is connected between said slider and the pivotal connection between said lower end of said seat back support and said seat support.

* * * * *